US006861623B1

(12) United States Patent
Wong

(10) Patent No.: US 6,861,623 B1
(45) Date of Patent: Mar. 1, 2005

(54) EXTENDABLE HEATED HAIR CURLER

(75) Inventor: Kin Man Wong, Hong Kong Sar (CN)

(73) Assignee: Hang Shun Hing Company Limited, Hong Kong (CN)

( * ) Notice: Subject to any disclaimer, the term of this patent is extended or adjusted under 35 U.S.C. 154(b) by 0 days.

(21) Appl. No.: 10/725,796

(22) Filed: Dec. 2, 2003

(51) Int. Cl.[7] ..... H05B 1/00

(52) U.S. Cl. ..... 219/528; 219/222; 219/225; 219/226

(58) Field of Search ..... 219/528, 222, 219/226, 534, 535; 132/221–230, 235, 243, 245, 246, 247, 261–265

(56) References Cited

U.S. PATENT DOCUMENTS 1,400,305 A * 12/1921 Miller ..... 132/229
2,892,460 A * 6/1959 Leclabart ..... 132/245
3,498,300 A * 3/1970 Lehn ..... 132/251
3,593,724 A * 7/1971 Leal ..... 132/254
3,673,382 A * 6/1972 Gaffney et al. ..... 219/222
4,267,851 A * 5/1981 Plaisted ..... 132/229
5,530,225 A * 6/1996 Hajaligol ..... 219/535
5,622,193 A * 4/1997 Pekarik ..... 132/254
5,746,228 A * 5/1998 Parker ..... 132/232
5,837,972 A * 11/1998 Padilla ..... 219/225

FOREIGN PATENT DOCUMENTS

DE 20116021 U1 * 1/2002 ..... A45D/6/00

* cited by examiner

*Primary Examiner*—Robin O. Evans
*Assistant Examiner*—Vinod Patel
(74) *Attorney, Agent, or Firm*—Alix, Yale & Ristas, LLP

(57) ABSTRACT

A heated hair curler includes a first portion having a heating element and an electric terminal in circuit with the heating element. A second portion is attached to the first portion in heat exchange relationship with it and is reconfigurable with respect to the first portion so as to alter the overall length of the hair curler. There are intermeshing elongate fingers that slide upon one another as the curler is reconfigured.

4 Claims, 2 Drawing Sheets

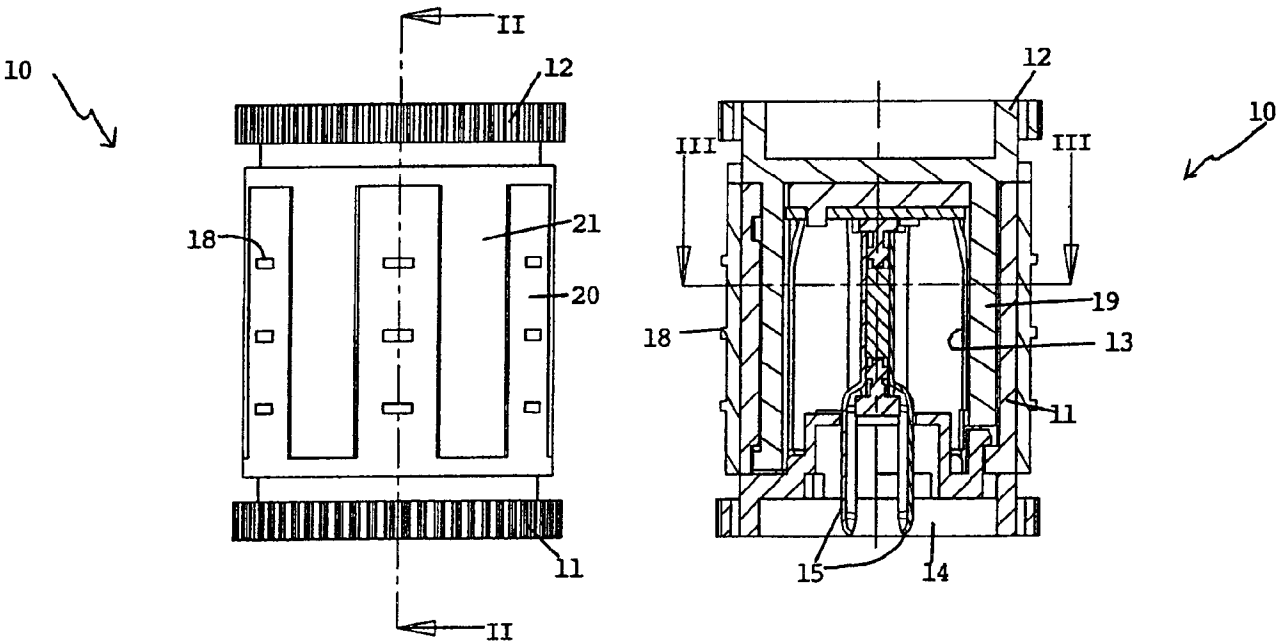
FIG. 2
FIG. 1
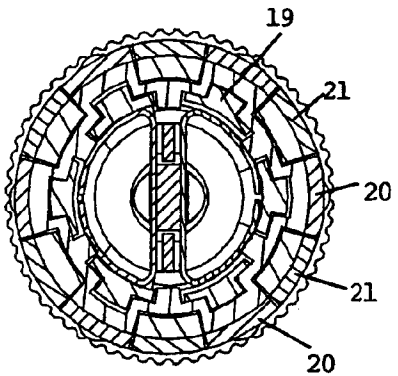
FIG. 3

EXTENDABLE HEATED HAIR CURLER

BACKGROUND OF THE INVENTION

The present invention relates to hair curlers. More particularly, although not exclusively, the invention relates to an extendable heated hair curler.

Heated hair curlers are known. Often a set of such curlers is provided in a kit that comprises a carry bag or case within which a mounting base is located. Upon the mounting base, there is an array of upstanding electrical contact posts upon which individual curlers are fitted to receive electricity to energise their internal heating elements. The curlers are of a generally cylindrical shape and are of fixed length suitable for hair curling purposes. The fixed length of the cylinders means that the carry bag or case must be bulky. This presents an inconvenience to a user who might like to store the kit in a handbag for example.

OBJECTS OF THE INVENTION

It is an object of the present invention to overcome or substantially ameliorate the above disadvantage and/or more generally to provide an extendable heated hair curler.

DISCLOSURE OF THE INVENTION

There is disclosed herein a heated hair curler comprising:

a first portion including a heating element and an electric terminal in circuit with the heating element, and a second portion attached to the first portion in heat exchange relationship therewith and being reconfigurable with respect to the first portion so as to alter an overall length of the hair curler.

Preferably the first portion includes a recess by which the first portion can be mounted upon so as to receive an electrical contact post of a base comprising an array of such contact posts, and wherein the electric terminal is is in or alongside the recess.

Preferably the first and second portions are substantially cylindrical and comprise intermeshing elongate fingers that slide upon one another as the curler is reconfigured.

Preferably the first or second portion comprises a pair of indents at opposite ends thereof and the other of said first or second portions comprises a toe that can click into either one of the indents to define fully extended and fully retracted configurations of the hair curler respectively.

Preferably at least some of the fingers comprise external ribs with which hair can engage in use.

BRIEF DESCRIPTION OF THE DRAWINGS

A preferred form of the present invention will now be described by way of example with reference to the accompanying drawings, wherein:

FIG. 1 is a schematic elevation of an extendable heated hair curler in a retracted configuration, FIG. 2 is a schematic cross-sectional elevation of the hair curler of FIG. 1 taken at II—II, FIG. 3 is a schematic cross-sectional plan view of the hair curler of FIG. 2 taken at III—III.

DESCRIPTION OF THE PREFERRED EMBODIMENT

Figure 5:
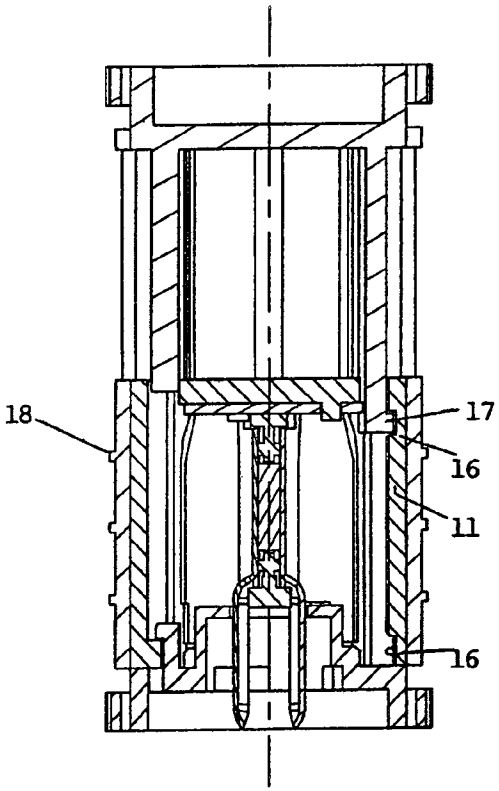
FIG. 5 is a schematic cross-sectional elevation of the hair curler of FIG. 4 taken at V—V.
Figure 4:
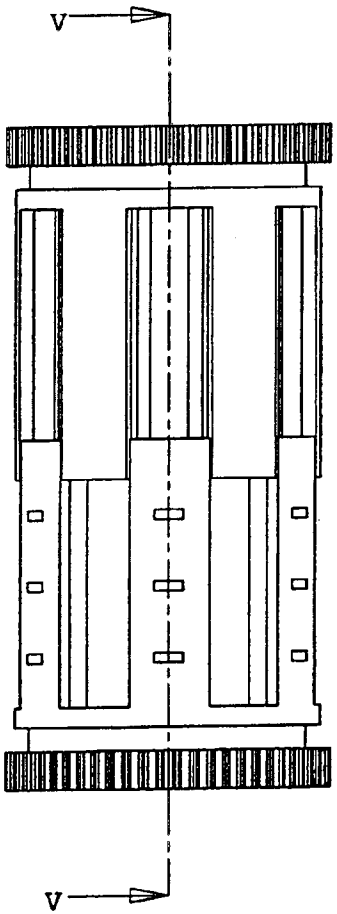
FIG. 4 is a schematic elevation of the hair curler of FIG. 1 in an extended configuration.

In the accompanying drawings there is depicted schematically a heated hair curler 10. Curler 10 comprises a first portion 11 and a second portion 12, each typically formed of both plastics and metallic parts.

The first portion 11 has a bottom recess 14 into which their extends a pair of electric terminals 15. The bottom recess can be fitted over an electric contact post of an array of such posts upon a base of a kit as described above. In such manner, electricity is provided to the terminals 15. Connected electrically with the terminals 15 is a heating element 13 which bears against elongate metallic heat-retaining/heat transfer bars 19 of the second portion 12 as shown.

The first portion 11 of the curler has an array of upstanding fingers 20. The second portion 12 has an array of depending fingers 21 that intermesh with upstanding fingers 20 in telescopic fashion.

The metallic bars 19 are located immediately behind each upstanding finger 20 and so heat is transferred thereto. In the retracted configurations of the hair curler as depicted in FIGS. 1 to 3, heat is transferred from the upstanding fingers 20 to the depending fingers 21 by conduction.

At the inside surface of each upstanding finger 20 of the first portion 11, there is a pair of indents 16. There is a toe 17 at the bottom of the second portion 12 that is received by one of the indents 16 to maintain the retracted or extended configurations of the curler respectively.

In use the curler is retracted and placed upon an electric contact post of the curler kit base and a switch is activated to commence heating of the heating element 13. By conduction from the heating elements, the fingers 20 and 21 are heated. Once sufficient heat is retained by the fingers (say after a pre-set time interval), the curler can be extended and used to curl hair a known manner. Once curling is completed, the curler can be retracted and stored upon the electric contact post of the curling kit.

It should be appreciated that modifications and alterations obvious to those skilled in the art are not to be considered as beyond the scope of the present invention. For example, the depending fingers 21 might also be provided with ribs 18.

What is claimed is:

1. A heated hair curler comprising:

a central portion including a heating element and an electric terminal in circuit with the heating element, and an outer portion attached to the central portion and substantially surround the heating element and in heat exchange relationship with the central portion, the outer portion being reconfigurable with respect to the central portion to alter an overall length of the hair curler, and wherein the central and outer portions are substantially cylindrical and comprise intermeshing elongate fingers that slide upon one another as the curler is reconfigured.

2. The hair curler of claim 1 wherein the central portion includes a recess by which the central portion can be mounted upon so as to receive an electrical contact post of a base comprising an array of such contact posts, and wherein the electric terminal is in or alongside the recess.

3. The hair curler of claim 1 wherein the central or outer portion comprises a pair of indents at opposite ends thereof and the other of said central or outer portions comprises a toe that can click into either one of the indents to define fully extended and fully retracted configurations of the hair curler respectively.

4. The hair curler of claim 1 wherein at least some of the fingers comprise external ribs with which hair can engage in use.

* * * * *